United States Patent [19]

Kubo

[11] Patent Number: 4,594,302

[45] Date of Patent: Jun. 10, 1986

[54] DEVELOPING PROCESS FOR TWO-COLORED ELECTROPHOTOGRAPHY

[75] Inventor: Masahiko Kubo, Nara, Japan

[73] Assignee: Mita Industrial Co., Ltd., Osaka, Japan

[21] Appl. No.: 739,012

[22] Filed: May 29, 1985

[30] Foreign Application Priority Data

May 31, 1984 [JP] Japan ..... 59-112331
May 31, 1984 [JP] Japan ..... 59-112332

[51] Int. Cl.[4] ..... G03G 13/01

[52] U.S. Cl. ..... 430/42; 430/45; 430/46; 430/901

[58] Field of Search ..... 430/42, 45, 46

[56] References Cited

FOREIGN PATENT DOCUMENTS

| | | | |
|---|---|---|---|
| 55-38538 | 3/1980 | Japan | 430/45 |
| 56-22436 | 3/1981 | Japan | 430/42 |
| 56-104337 | 8/1981 | Japan | 430/45 |
| 56-104338 | 8/1981 | Japan | 430/45 |
| 56-144440 | 11/1981 | Japan . | |
| 58-102249 | 6/1983 | Japan . | |
| 58-102250 | 6/1983 | Japan . | |

*Primary Examiner*—Roland E. Martin
*Attorney, Agent, or Firm*—Spencer & Frank

[57] ABSTRACT

A developing process for two-colored electrophotography comprising: (1) charging the surface of a photoreceptor having a conductive substrate and two photosensitive layers successively formed on the conductive substrate, said photosensitive layers having different spectral sensitivities, (2) charging the surface of said photoreceptor with a different polarity from the charging polarity in step (1), (3) exposing a two-colored original to form electrostatic latent images, which have different polarities corresponding to the two-colored original, on the surface of said photoreceptor, (4) transferring a first color toner charged with a different polarity from the charging polarity of one of the electrostatic latent images on said electrostatic latent image to develop said electrostatic latent image iwth the first color toner, (5) exposing the surface of said photoreceptor to eliminate electric charges with the same polarity as the first color toner which are induced on the surface of said photoreceptor in the vicinity of said electrostatic latent image developed by the first color toner, and (6) transferring a second color toner charged with a different polarity from the charging polarity of the other electrostatic latent image on said other electrostatic latent image to develop said other electrostatic latent image with the second color toner.

5 Claims, 6 Drawing Figures

DEVELOPING PROCESS FOR TWO-COLORED ELECTROPHOTOGRAPHY

BACKGROUND OF THE INVENTION

1. Field of the Invention

This invention relates to an electrophotographic method for the formation of two-colored images. More particularly, it relates to a developing process for the formation of distinct images having two colors by minimizing the halo-effect.

2. Description of the Prior Art

In order to emphasize particular portions in documents, conference materials or the like printed by a color ink such as black, corrections, comments and underlines are made on the original document material or the like by the use of colored pencils (e.g., red pencils) which are distinguishable from the basic color (i.e., black) of the original. However, once the original documents or materials are copied by a copying machine to distribute to subscribers, conference members, etc., such corrections, comments and underlines are reproduced in black only, so that the corrections, comments and underlines no longer appear to be emphasized. The colors to be used for such corrections, comments or underlines do not usually have to correspond to the colors in the original, but they are required to be distinguishable from the basic color of the original.

For this purpose, various methods for the formation of two-colored images have been proposed in, for example, U.S. Pat. No. 4,189,224 and U.S. Pat. No. 4,413,899 both of which are patented to Ricoh Co. Ltd., Japan. According to these proposed methods, on a photoreceptor comprising a conductive substrate and a photoconductive layer formed on the conductive substrate, two kinds of electrostatic latent image having different polarities from each other which correspond to the two colors in the original are simultaneously formed, first. To the electrostatic latent images, two kinds of color developer charged with different polarities are adhered resulting in two-colored images, which are then subjected to a charging treatment to have the same polarity and transferred to a transfer paper followed by a fixing treatment. As the photoreceptor mentioned above, there have been two kinds of photoreceptor, one of which has a single photosensitive layer and an insulating layer on the photosensitive layer and the other of which has a photosensitive composite composed of two photosensitive layers of different spectral sensitivities. In the case where the photoreceptor is composed of a photosensitive composite, the electrostatic latent images having different polarities are formed by two charging treatments with different polarities and an exposing treatment, followed by a developing using a positively charged developer from a first developing means and a negatively charged developer from a second developing means, resulting in toner images having two colors.

In the developing step, as shown in FIGS. 5 and 6, the toner 200 from the second developing means is attached to the vicinity of the toner image 100 developed by the toner from the first developing means, resulting in a halo-image, namely a halo-effect. This phenomenon is assumed to result from electric charges located in the end portion of the electrostatic latent image on the photoreceptor. These electric charges which are charged with a different polarity from the charging polarity of the said electrostatic latent image, are induced from the ground to make toner to adhere to the surface of the photoreceptor with the electrostatic force of attraction thereof. The haloeffect is unavoidable in the formation of two-colored electrophotography as shown in FIG. 5(B), when the toner image 100 is a red color and the toner 200 located in the vicinity of the toner image 100 is a black color the red-image tends to be visually emphasized so that the halo-image with the black-colored toner is deemphasized. However, as shown in FIG. 5(A), when the toner image 200 is black and the toner 100 around the toner image 200 is red, the edge portion of the black-toner image 200 appears to be indistinguishable from the other.

SUMMARY OF THE INVENTION

The developing process for two-colored electrophotography of this invention which overcomes the above-discussed disadvantages and other numerous drawbacks and deficiencies of the prior art, comprises: (1) charging the surface of a photoreceptor having a conductive substrate and two photosensitive layers successively formed on the conductive substrate, said photosensitive layers having different spectral sensitivities, (2) charging the surface of said photoreceptor with a different polarity from the charging polarity in step (1), (3) exposing a two-colored original to form electrostatic latent images, which have different polarities corresponding to the two-colored original, on the surface of said photoreceptor, (4) transferring a first color toner charged with a different polarity from the charging polarity of one of the electrostatic latent images on said electrostatic latent image to develop said electrostatic latent image with the first color toner, (5) exposing the surface of said photoreceptor to eliminate electric charges with the same polarity as the first color toner which are induced on the surface of said photoreceptor in the vicinity of said electrostatic latent image developed by the first color toner, and, (6) transferring a second color toner charged with a different polarity from the charging polarity of the other electrostatic latent image on said other electrostatic latent image to develop said other electrostatic latent image with the second color toner.

When the first color toner is non-photoconductive, the exposure in step (5) is carried out using a lamp.

When the first color toner is photoconductive, the exposure in step (5) is carried out using a filter transmitting a light therethrough having a wavelength which makes photoconductive both the surface of said photoreceptor and the first color toner thereon.

Thus, the invention described herein makes possible the objects of (1) providing a developing process for two-colored electrophotography in which the attachment of the colored toner to the vicinity of the color toner image is minimized to thereby form distinct images having two colors with a suppressed halo-effect; and (2) providing a developing process for two-colored electrophotography which consists of simple steps.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
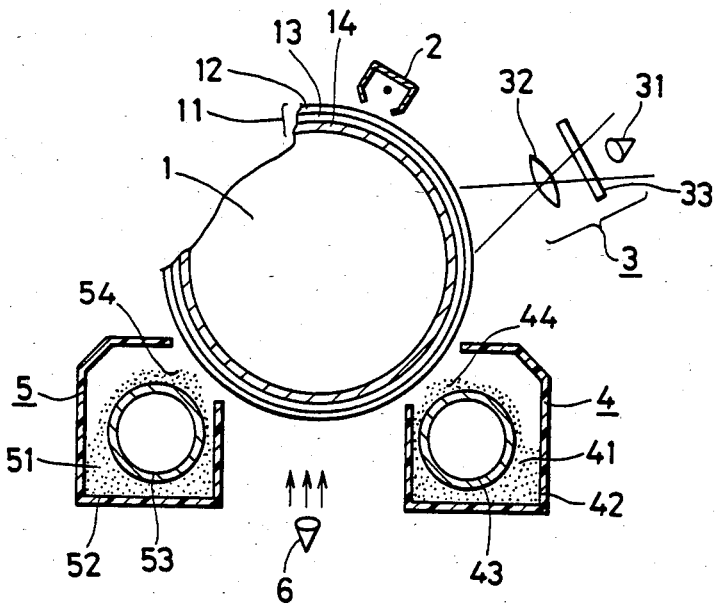
FIG. 1 is a partly sectional front view of a developing apparatus for the developing process of this invention.

As a photoreceptor, any of photoreceptors on which electrostatic latent images with positive and negative polarities are formed and maintained by a known exposure treatment can be used with this invention, an example of which is a photosensitive composite. The photosensitive composite comprises photosensitive layers having different spectral sensitivities and is made of, for example, inorganic photosensitive substances such as amorphous selenium, zinc oxide, etc., or organic photosensitive substances such as polyvinylcarbazole, etc., but is not limited thereto. When the photosensitive layer is made of amorphous selenium, it is positively charged due to the p-electroconductivity of the amorphous selenium. When it is made of zinc oxide, it is negatively charged due to the n-electroconductivity of zinc oxide.

As a conductive substrate which supports the photosensitive layers thereon, any conductive substrate known to be useful for photoreceptors can be used, examples of which are an electroconductive metal such as aluminium, a substrate prepared by disposing an electroconductive substance on a plastic film base by vacuum evaporation deposition, or the like.

A dielectric can be used, instead of the photoreceptor, on which electrostatic latent images are formed with positive and negative polarities by means of pin electrodes or the like.

Exposure is carried out between the developing treatment of one of the electrostatic latent images with the first color toner and the developing treatment of the other with the second color toner, thereby minimizing the influence of electric charges induced on the surface of the photoreceptor in the vicinity of the first color toner image upon the development of the said other latent image with the second color toner. This exposure is carried out using a lamp when the first color toner is non-photoconductive. As the non-photoconductive color toner, any color toner known to be useful for two-colored electrophotography can be used, an example of which is composed of color toner particles having a diameter in the range of from 1 to 50 μm, which are prepared by dispersing pigments into a resin binder together with, as desired, a charge-control agent and/or a toner-blocking agent. The color toner is used, as a toner of a dual-component developer, with a magnetic carrier, but it can be used as a mono-component developer when it contains a magnetic powder therein such as magnetite, ferrite, etc. The pigments are made of, for example, carbon black when they are a black color; and red iron oxide, cadminum red, fast red, etc., when they are a red-color. Examples of the resin binder are styrene resins, acrylic resins, polyester resins, etc. Examples of the charge-regulating agent are an oil-soluble dye such as nigrosine base (C.I.5045), oil black (C.I.26150), spirane blue; metal naphthenates; metallic fattiate soaps; resinate soaps; and azo dyes containing metals. Examples of the toner-blocking agent are silica, alumina, talc, etc.

Alternatively, when the first color toner is photoconductive, the above-mentioned exposure is carried out using a filter transmitting light therethrough having a wavelength which makes photoconductive both the surface of the photoreceptor and the first color toner thereon. A photoconductive pigment used for the photoconductive color toner, is at least one selected from an inorganic pigment such as zinc oxide, titanium oxide, etc., and an organic pigment such as a phthalocyanine pigment (e.g., non-metallic β-phthalocyanine (C.I.74100)), a bisbenzoimidazole pigment (e.g., perylene (C.I.71105)); an indigo pigment (e.g., thioindigo (C.I.73360); an azo pigment (e.g., diamine blue (C.I.21180)); a perylene pigment; a quinacridone pigment, etc. The photoconductive pigment in the color toner is in the range of from 10 to 35% by weight, preferably 12 to 30% by weight. If it is over 35% by weight, the mechanical strength of the color toner decreases resulting in deterioration of the color toner so that the durability thereof will be shortened. If it is less than 10% by weight, the decay rate of electric charges on the toner in the exposure step decreases. As the resin binder, any resin binder known to be useful for a photoconductive toner can be used, examples of which are natural resins such as balsam resins, rosins or the like; synthesized resins such as vinyl resins, acrylic resins, styrene resins, polyamide resins or the like; or mixture thereof, which exhibit an adhesiveness by a heat or pressing treatment. The resins used herein are either thermoplastic resins or thermosetting resins. Additives are used as desired. The pigment are, for example, photoconductive zinc oxide or titanium oxide particles, on the surface of each of which a sensitizing coloring matter such as acridine orange, Rhodamine, erythrosine, etc., is bound in a single layered or laminating form. Dyes are used as desired.

The second color toner to be used together with the photoconductive color toner as the first color toner is not required to be photoconductive, but it shoulder be a toner of a mono- or dual-component system.

When the first color toner is photoconductive, the exposure is carried out using a filter transmitting a light therethrough having a wavelength which makes photoconductive both the surface of the photoreceptor and the first color toner thereon, thereby minimizing the influence of electric charges induced on the surface of the photoreceptor in the vicinity of the first photoconductive color toner image upon the development of the electrostatic latent image with the second color toner.

EXAMPLE 1

FIG. 1 shows a developing apparatus for this invention which comprises a photoreceptor drum 1, a charging means 2 disposed near the drum 1, a first exposing means 3 near the drum 1 down stream of the charging means 2, a first developing means 4 near the drum 1 down stream of the first exposing means 3, a second developing means 5 near the drum 1 down stream of the first developing means 4, and a second exposing means 6 such as a discharging lamp near the drum 1 between the first and the second developing means 4 and 5. The photoreceptor drum 1 is composed of the first and the second photosensitive layer 12 and 13, having different spectral sensitivities, which are laminated on a conductive substrate 14.

Figure 2:
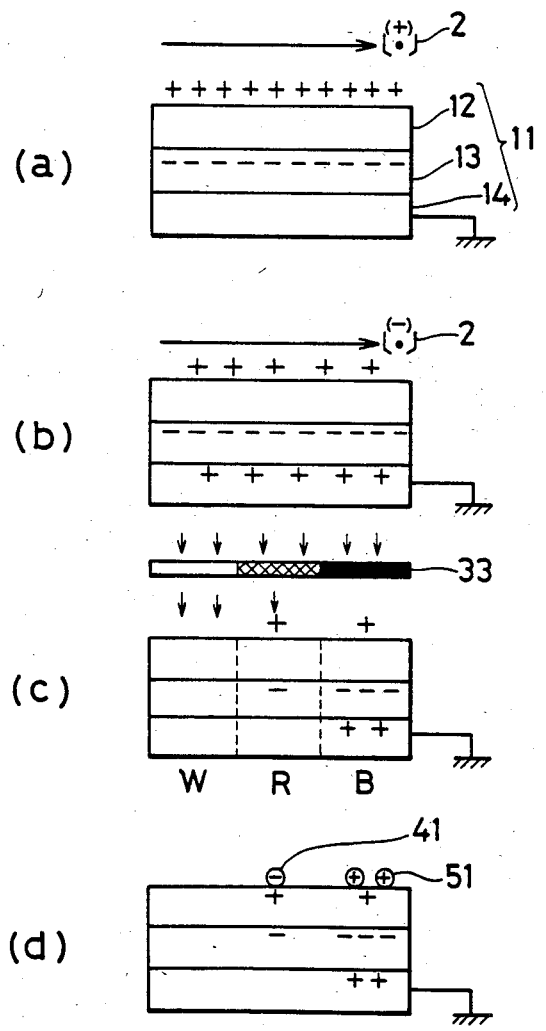
FIG. 2 is a schematic illustration showing the developing process using the developing apparatus in FIG. 1.

The developing apparatus operates as follows:

As shown in FIG. 2, the photoreceptor 11, which is constituted by the first and the second photosensitive layers 12 and 13 and the conductive substrate 14, is subjected to a first charging treatment with, for example, a positive polarity by the charging means 2 (FIG. 2(*a*)), followed by a second charging treatment with a different polarity (i.e., a negative polarity) from the charging polarity in the first charging treatment FIG. 2(*b*)) to obtain the first photosensitive layer 12 charged with a positive polarity and the second photosensitive layer 13 charged with a negative polarity, resulting in a double-electric layer consisting of different polarities on the photoreceptor 11. The charging process is, of course, carried out depending upon the charging characteristic of each of the photosensitive layers 12 and 13. The charging means 2 comprises, for example, an AC corona charger generating either positive electric charges or negative charges, or a pair of corona chargers generating positive and negative electric charges, respectively.

Then, on the photoreceptor 11 having a double-electric layer, an exposure corresponding to two colors of the original 33 is carried out by means of a first exposing means 3 (FIG. 2(*c*)), causing photoconduction in the corresponding region of each of the photosensitive layers 12 and 13 depending upon each of the two color wavelengths. For example, the region on the photosensitive layers 12 and 13 corresponding to a white color region W (which corresponds to a white background) becomes photoconductive so that potential thereon becomes zero, while the region R (which corresponds to a red color in the original) on the second photosensitive layer 13 which has a sensitivity to the red color wavelength alone becomes photoconductive decreasing in the negative electric charges on the second photosensitive layer 13. The positive electric charges still remain on the first photosensitive layer 12. Since the light does not reach the region B in the photoreceptor 11 corresponding to the black region in the original, the electric resistance thereof is kept at the same level as that prior to the exposure, resulting in electrostatic latent images having different polarities on the photoreceptor 11 which correspond to the two colors in the original 33. The above-mentioned first exposing means 3 comprises a light source 31 and an optical system 32 which makes an optical image corresponding to the original 33 on the photosensitive layer 12.

The electrostatic latent images having the different polarities are then subjected to a developing treatment with a color toner by means of a first developing means 4 which comprises a developer container 42, the first color toner 41 and a carrier contained in the container 42, and a sleeve 43. The container 42 is made of, for example, a non-magnetic resin such as pholyethylene/-terephthalate or the like. The sleeve 43 is made of a non-magnetic and conductive material with respect to at least the surface thereof, at the back of which a magnet or the like is disposed. The first color toner 41 and the carrier are mixed by an agitation means within the container 42 such that friction therebetween induces an electrostatic charge having e.g., a negative polarity on the first toner 41. On the sleeve 43, the charged first color toner 41 forms a magnetic brush 44, which is in contact with the photoreceptor 11 so that one of the electrostatic latent images thereon is developed by the first color toner. The development with the first color toner is not limited to a known contact development, but is carried out by a known non-contact development such as a "jumping" development, a touch-down development, etc. In the surrounding area of the electrostatic latent image developed by the first color toner, electric charges having a different polarity from the charging polarity of the said latent image (i.e., the same polarity as the first color toner) are induced.

In order to minimize the induced charges, then, the surface of the photoreceptor 11 is subjected to an exposing treatment by means of the second exposing means 6, in such a manner that the induced charges in the surrounding area of the above-mentioned latent image disappear or are minimized without influence on the charges of the latent image.

Then, the other latent image remaining on the photoreceptor 11 is developed with the second color toner by means of the second developing means 5 (FIG. 2(*d*)) which has the same structure and developer as the first developing means 4 except the color of the toner. Since the above-mentioned induced charges do not exist in the surrounding area of the first-color toner image, the second color toner 51 is not bound to the surroundings of the first-color toner image so that the halo-effect can be significantly suppressed.

In order that the resulting two-colored images are realized to be clear and distinct, it is preferable that the first color toner 41 is black and the second color toner 51 is red. The colors of the color toners 41 and 51 are not, of course, limited to black and red respectively. But these colors show the greatest reduction in the halo-effect.

The two-colored toner images obtained are then charged with the same polarity (e.g., a positive polarity) by a charging means (not shown) positioned down stream of the second developing means 5, followed by an electrostatical transferring treatment to transfer the toner images onto the back of a transfer paper, resulting in a two-colored (e.g., red and black) image which corresponds to the colors in the original and in which the two colors are easily distinguishable.

EXAMPLE 2

Figure 3:
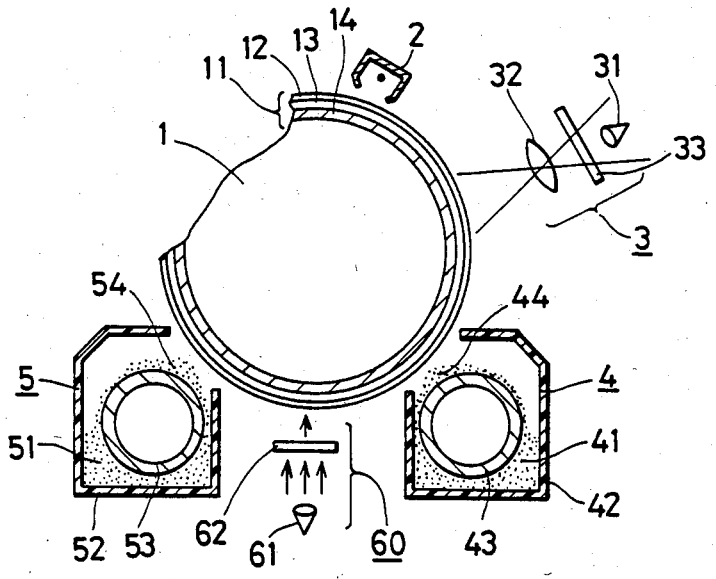
FIG. 3 is a partly sectional front view of another developing apparatus for the developing process of this invention.

FIG. 3 shows another developing apparatus for this invention which has the same structure as that in shown in FIG. 1, except that a discharging means 60 is used instead of the second exposing means 6. The discharging means 60 comprises a discharge lamp 61 and a filter 62 transmitting therethrough a light from the lamp 61 having a wavelength which makes photoconductive both the surface of the photoreceptor 11 and the photoconductive color toner 41.

Figure 4:
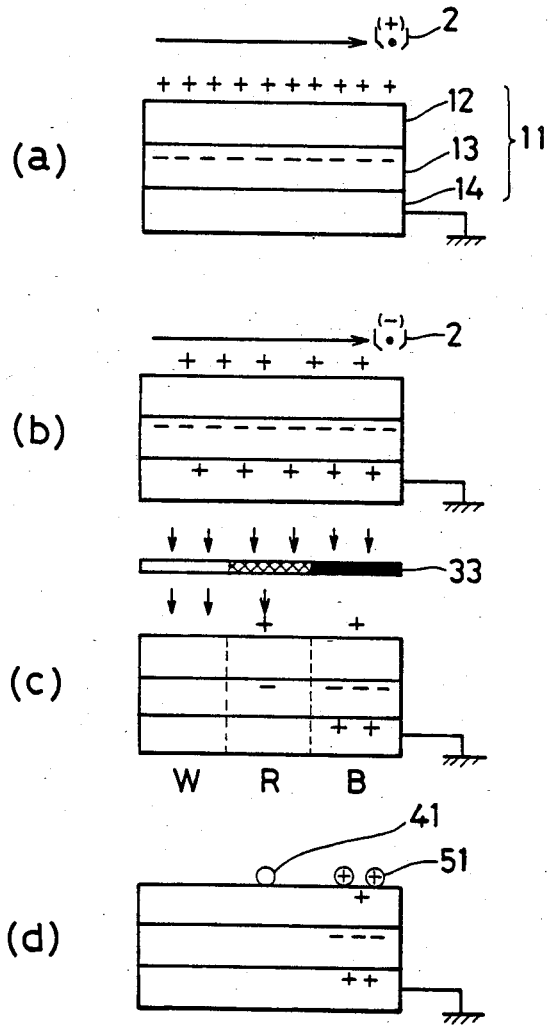
FIG. 4 is a schematic illustration showing the developing process using the developing apparatus in FIG. 3.
Figure 5:
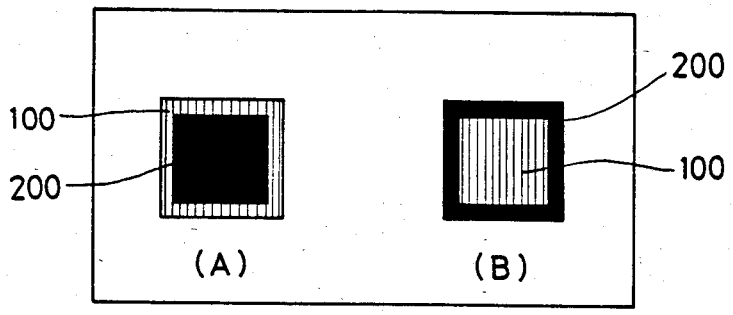
FIG. 5 is an illustration showing a halo-effect produced by the conventional developing process for two-colored electrophotography.
Figure 6:
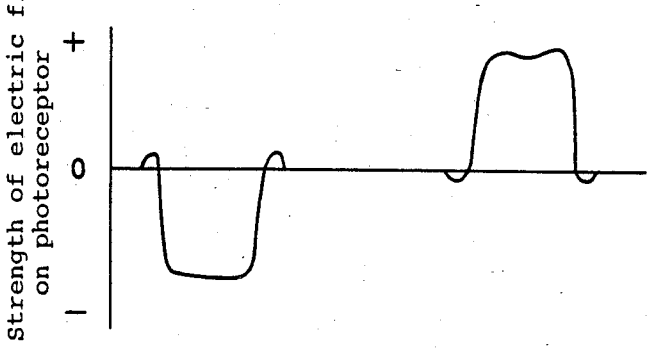
FIG. 6 shows the strength of the electric field on the photoreceptor at the time when the halo-effect was produced.

As shown in FIG. 4, the photoreceptor 11 is subjected to the first charging treatment with, for example, a positive polarity (FIG. 2(*a*)), followed by the second charging treatment with a different polarity (i.e., a negative polarity) from the charging polarity in the first charging treatment (FIG. 2(*b*)) in the same manner as in Example 1, resulting in a doubleelectric layer consisting of different polarities on the photoreceptor.

Then, on the photoreceptor 11 having a double-electric layer, an exposure corresponding to two colors of the original 33 is carried out by means of the exposing means 3 (Example 2(*c*)) in the same manner as in Example 1, causing photoconductive in the corresponding region of each of the photosensitive layers 12 and 13 depending upon each of the two color wavelengths, and resulting in electrostatic latent images having different polarities on the photoreceptor which correspond to the two colors in the original.

The latent images are then subjected to a developing treatment with a color toner by the first developing means 4 in the same manner as in Example 1.

The first photoconductive color toner 41, which is electrostatically charged, in advance, within the developer container 42 forms a magnetic brush 44, which is in contact with the photoreceptor 11 so that one of the latent images thereon is developed by the first photoconductive color toner 41. The development is not limited to a known contact development, but is carried out by a known non-contact development such as a "jumping" development, a touch-down development, etc.

In order to minimize the charges which are induced in the surrounding area of the first color toner image, the surface of the photoreceptor 11 is exposed through the discharging means 60, so that the first photoconductive toner 41 on the latent image is rendered photoconductive, resulting in the migration of the negative electric charges of the photoconductive color toner 41 to the positive electric charges of the latent image, and the disappearance of both electric charges thereof. As the charges in the skirt area of the latent image disappear, the induced charges having a different polarity from that of the latent image (i.e., the same polarity as the first photoconductive color toner 41) are attracted below the first photoconductive color toner 41, and no longer exist in the surrounding area thereof.

Then, the other latent image remaining on the photoreceptor 11 is developed with the second color toner 51 by the second developing means 5 (FIG. 2(*d*)) in the same manner as in Example 1. Since the above-mentioned induced charges no longer exist in the surrounding area of the first photoconductive color toner 41, the second color toner 51 does not adhere to the skirt area of the toner image so that the halo-effect can be suppresed.

The second color toner 51 is not required to be photoconductive. In order that the resulting two-colored toner images are realized to be clear and distinct, the colors of the first and the second color toners 41 and 51 are preferably black and red, respectively, but are not limited thereto.

The two-colored toner images are then charged with the same polarity (e.g., a positive polarity) by a charging means (not shown) positioned downstream of the second developing means 5, followed by an electrostatical transferring treatment to transfer the toner images on to a transfer paper, resulting in a two-colored (e.g., red and black) image which corresponds to the two colors in the original and in which the two colors are easily distinguishable.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A developing process for two-colored electrophotography comprising:

(1) charging the surface of a photoreceptor having a conductive substrate and two photosensitive layers successively formed on the conductive substrate, said photosensitive layers having different spectral sensitivities, (2) charging the surface of said photoreceptor with a different polarity from the charging polarity in step (1), (3) exposing a two-colored original to form electrostatic latent images, which have different polarities corresponding to the two-colored original, on the surface of said photoreceptor, (4) transferring a first color toner charged with a different polarity from the charging polarity of one of the electrostatic latent images on said electrostatic latent image to develop said eletrostatic latent image with the first color toner, (5) exposing the surface of said photoreceptor to eliminate electric charges with the same polarity as the first color toner which are induced on the surface of said photoreceptor in the vicinity of said electrostatic latent image developed by the first color toner, and (6) transferring a second color toner charged with a different polarity from the charging polarity of the other electrostatic latent image on said other electrostatic latent image to develop said other electrostatic latent image with the second color toner.

2. A developing process for two-colored electrophotography according to claim 1, wherein said first color toner is non-photoconductive.

3. A developing process for two-colored electrophotography according to claim 2, wherein said exposure in step (5) is carried out using a lamp.

4. A developing process for two-colored electrophotography according to claim 1, wherein said first color toner is photoconductive.

5. A developing process for two-colored electrophotography according to claim 4, wherein said exposure in step (5) is carried out using a filter transmitting a light therethrough having a wavelength which makes photoconductive both the surface of said photoreceptor and the first color toner thereon.

* * * * *